US006839916B1

(12) United States Patent
Chen

(10) Patent No.: US 6,839,916 B1
(45) Date of Patent: Jan. 11, 2005

(54) BELT FOR CASUAL WEAR

(76) Inventor: Mike Chien-Fang Chen, No. 17, Kung 6 Road, Linkou 2nd Industrial Park, Taipei Hsien (TW)

( * ) Notice: Subject to any disclaimer, the term of this patent is extended or adjusted under 35 U.S.C. 154(b) by 0 days.

(21) Appl. No.: 10/672,639

(22) Filed: Sep. 26, 2003

(51) Int. Cl.[7] ..... A41F 9/00
(52) U.S. Cl. ..... 2/322
(58) Field of Search ..... 2/338, 310–313, 2/316–323, 326–331, 336, 300; 24/178, 182, 265 BC, 265 A

(56) References Cited

U.S. PATENT DOCUMENTS 2,629,104 A * 2/1953 Easlick ..... 2/322
3,920,166 A * 11/1975 Hogensen, Jr. ..... 224/586
5,046,197 A * 9/1991 Chernuchin et al. ..... 2/322
5,873,133 A * 2/1999 Jurga et al. ..... 2/322
6,513,224 B1 * 2/2003 Chen et al. ..... 29/469

* cited by examiner

*Primary Examiner*—Tejash Patel
(74) *Attorney, Agent, or Firm*—Troxell Law Office PLLC

(57) ABSTRACT

A belt for casual wear is constructed to include a buckle base with an integrated front knuckle to hold a buckle frame and a prong pin, an adjustment frame, a tailpiece injection-molded from plastics, and a belt body, the belt body having one end inserted through the buckle base and fastened to the adjustment frame with stitches and the other end fastened to the tailpiece with stitches.

1 Claim, 9 Drawing Sheets

BELT FOR CASUAL WEAR

BACKGROUND AND SUMMARY OF THE INVENTION

The present invention relates to belt to be worn round the waist and, more particularly, to a belt for casual wear, which is easy and inexpensive to manufacture.

FIG. 1 illustrates a belt 8 for casual wear according to the prior art. This design of belt is comprised of a number of parts, thereby resulting in complicated manufacturing process and high manufacturing cost. The formation of the tailpiece of this design of belt 8 comprises the steps of:

A: Shape forming where a belt punch (not shown) is used to cut a leather into a tailpiece 81 having a plurality of punch holes 811 longitudinally aligned in a line (see FIG. 2);

B: Opening forming: where a leather splitter (not shown) is used to split one end of the tailpiece 81, forming an opening 812 (see FIG. 3); and C: Marking: where the back side of the tailpiece 81 is stamped with country of origin 813 and model number 814 (see FIG. 4).

The formation of the keeper of the aforesaid prior art belt 8 comprises the steps of:

A: Shape cutting: where the belt punch is operated to cut a leather into a narrow piece for keeper 82 (see FIG. 5); and B: Binding: where the ends of the narrow piece for keeper 82 are joined with staples (see FIG. 6).

The formation of the headpiece of the aforesaid prior art belt 8 comprises the steps of:

A: Shape forming: where the belt punch is operated to cut a leather is cut into a tailpiece 81 having an oblong hole 831 (see FIG. 7);

B: Insertion of buckle 85: where the headpiece 83 is inserted through the buckle 85 and then folded up C: Stitching: where the folded headpiece 83 is fastened with stitches 832 to secure the buckle 85 to the headpiece 83:

D: Insertion of the keeper 82: where the headpiece 83 is inserted through the keeper 82; and E: Insertion of connecting ring 86: where the headpiece 83 is inserted through the connecting ring 86 and then fastened with stitches 833 to secure the connecting ring 86 to the headpiece 83 (see FIG. 8).

The formation of the headpiece of the aforesaid prior art belt 8 comprises the step of using the belt punch to cut a leather into the desired belt body 84.

The assembly process of the aforesaid prior art belt 8 comprises the steps of (a) inserting the belt body 84 through the adjustment frame 87 and then stitching the belt body 84 to secure the adjustment frame 87 to the belt body 84; (b) inserting the belt body 84 through the connecting ring 86 and then the adjustment frame 87; and (c) fastening the tail end 841 of the belt body 84 to the opening 812 of the tailpiece 81 with stitches. Thus, the desired belt 8 is finished.

The aforesaid prior art belt has numerous drawbacks as follows:

1. Because the belt is comprised of a number of parts, the assembly process of the belt wastes much time and labor.
2. The tailpiece, the keeper, and the headpiece must be separately made and then fastened to one another with the connecting ring and the adjustment frame. Because of complicated assembly process, it is difficult to achieve quality control.
3. When forming an opening at one end of the tailpiece, it is difficult to accurately and equally split the end of the tailpiece. Uneven splitting of the tailpiece affects the structural strength.
4. It is inconvenient to stitch the bolded part of the headpiece.

Therefore, it is desirable to provide a belt for casual wear that eliminates the aforesaid drawbacks.

The present invention has been accomplished under the circumstances in view. It is the main object of the present invention to provide a belt for casual wear, which is comprised of less number of parts, saving material consumption. It is another object of the present invention to provide a belt for casual wear, which is easy and inexpensive to manufacture. It is still another object of the present invention to provide a belt for casual wear, which enables the belt length to be conveniently adjusted during fabrication.

To achieve these and other objects of the present invention, the belt comprises a buckle base stamped from a metal plate, the buckle base having two upright sidewalls, two pivot holes respectively cut through the upright sidewalls, a transverse insertion slot extended between the upright sidewalls, two side notches respectively formed at the upright sidewalls in communication with two distal ends of the transverse insertion slot, a front knuckle, a longitudinal slot extended to a middle part of the front knuckle, and a prong pin pivotally disposed at a middle part of the front knuckle; a pivot, the pivot has two end rods respectively pivotally fastened to the pivot holes at the upright sidewalls of the buckle base; a metal buckle frame, the buckle frame having a substantially rectangular open body fastened pivotally with the front knuckle and the prong pin; an adjustment frame, the adjustment frame having a transversely extended middle rod and two insertion slots separated by the transversely extended middle rod; a tailpiece injection-molded from plastics, the tailpiece having an opening at a front end thereof, and a plurality of punch holes longitudinally aligned in a line, and a belt body made of elastic fabric, the belt body having a first end inserted through the insertion slots of the adjustment frame and fastened to the transversely extended middle rod of the adjustment frame with stitches, and a second end inserted through the transverse insertion slot of the buckle base over the pivot and then inserted through the insertion slots of the adjustment frame and fastened to the opening of the tailpiece with stitches.

DETAILED DESCRIPTION OF THE INVENTION

Figure 1:
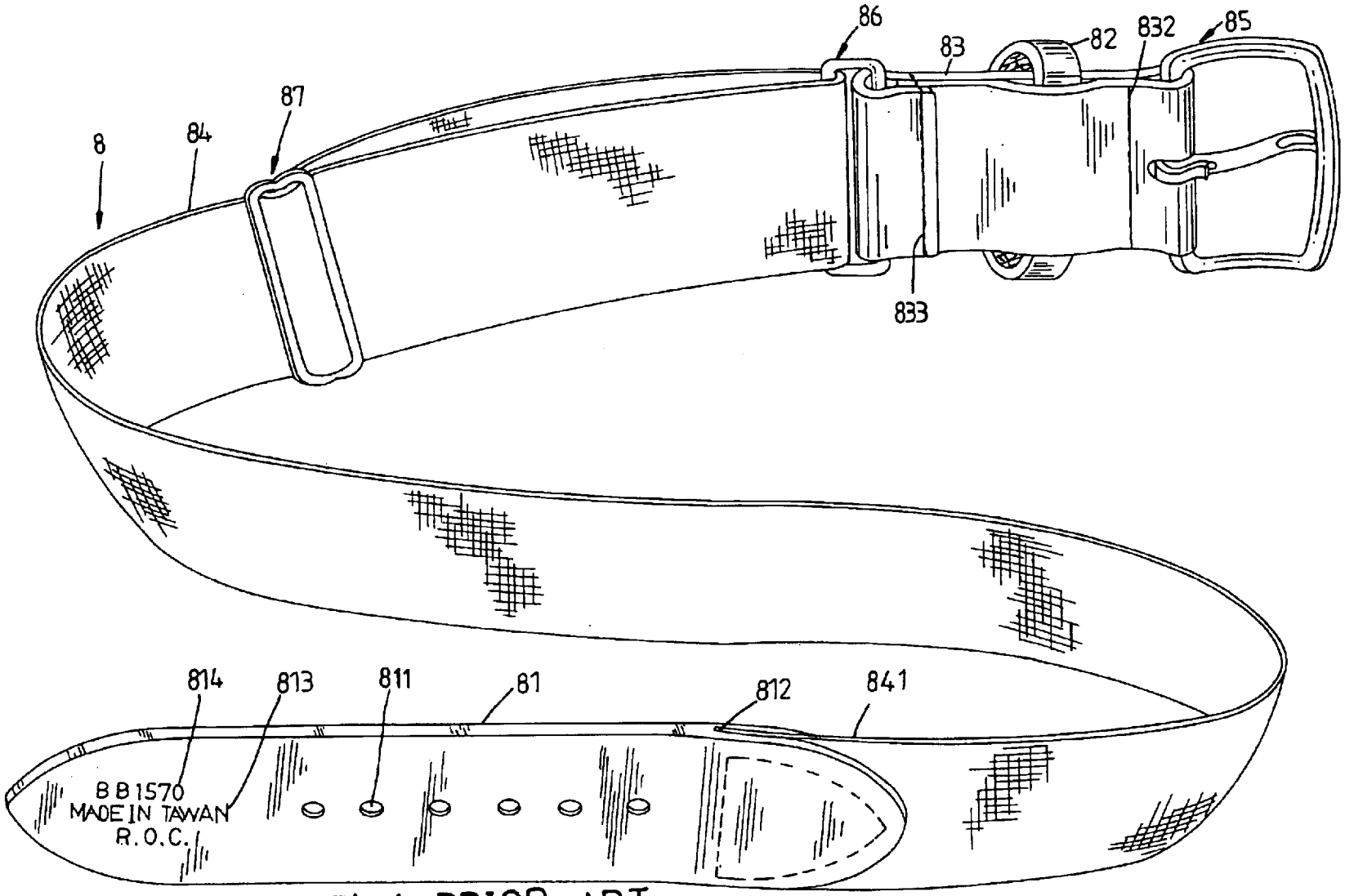
Fig.1 PRIOR ART
FIG. 1 is a perspective view of a belt for casual wear according to the prior art.
Figure 2:
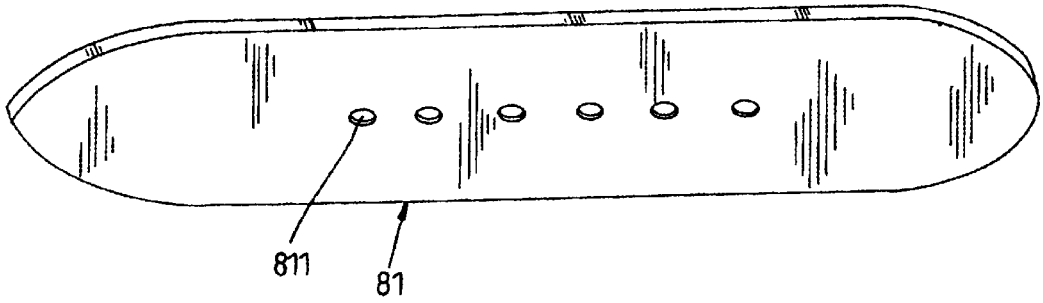
Fig. 2 PRIOR ART
FIG. 2 is an elevational view of a tailpiece before splitting and marking according to the prior art.
Figure 3:
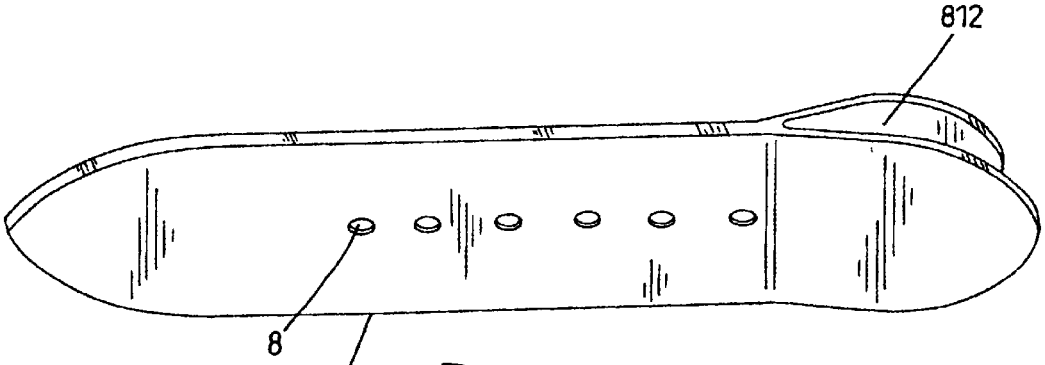
Fig. 3 PRIOR ART
FIG. 3 is similar to FIG. 2 but showing an opening formed at one end of the tailpiece.
Figure 4:
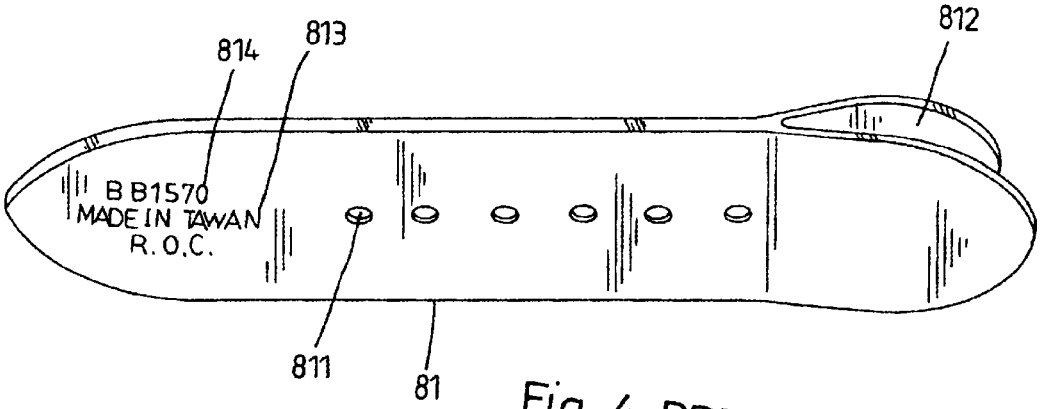
Fig. 4 PRIOR ART
FIG. 4 is similar to FIG. 3 but showing the marks of country of origin and model number marked on the inner side of the rear end of the tailpieces according to the prior art.
Figure 5:
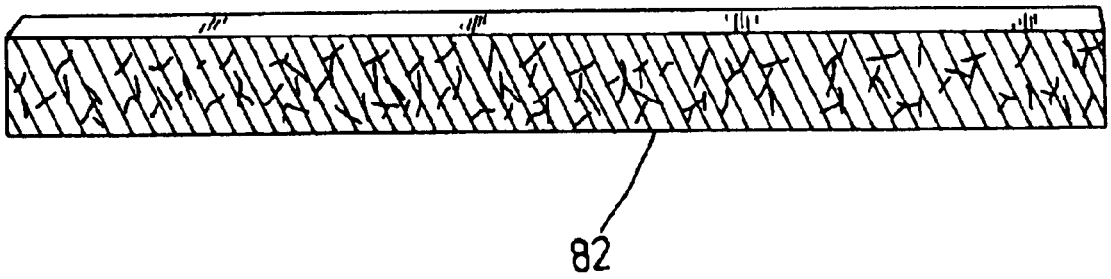
Fig. 5 PRIOR ART
FIG. 5 is a perspective view of a narrow piece of leather for keeper according to the prior art.
Figure 6:
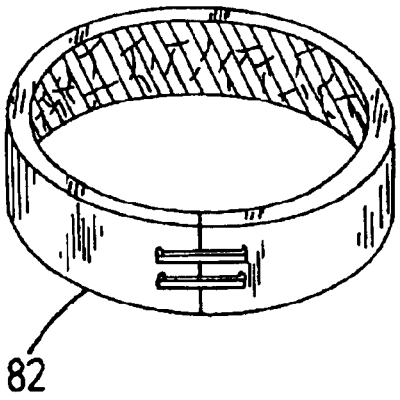
Fig. 6 PRIOR ART
FIG. 6 is an elevational view of a keeper for belt according to the prior art.
Figure 7:
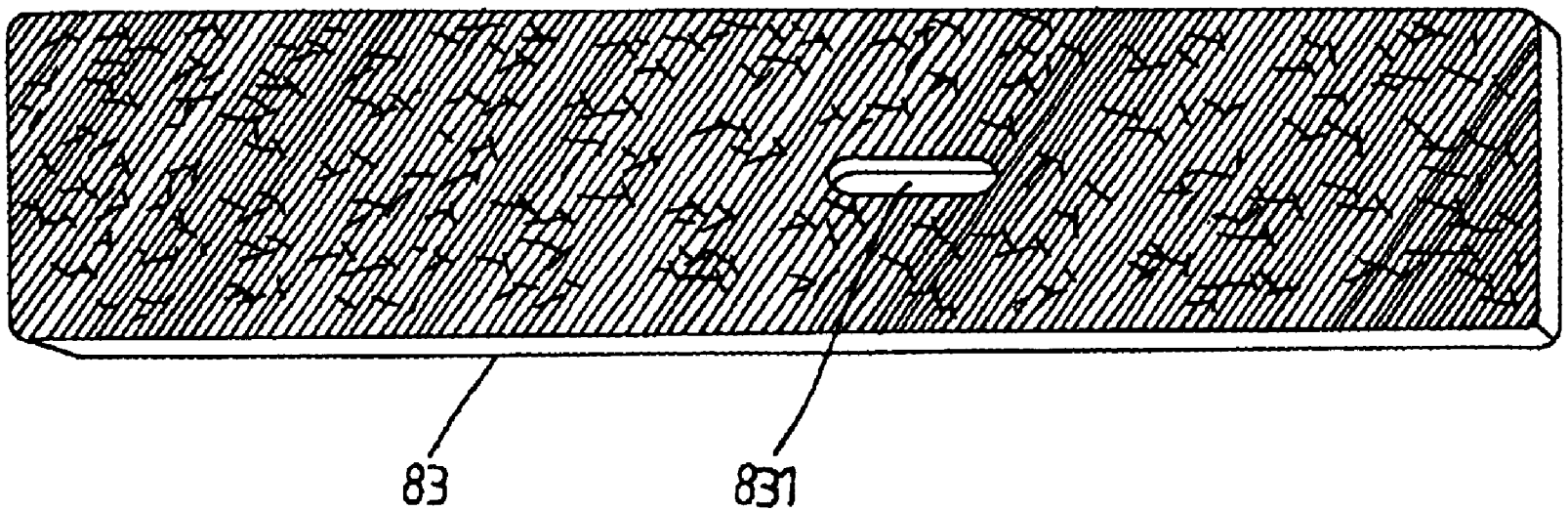
Fig. 7 PRIOR ART
FIG. 7 is an extended out view of a headpiece for belt according to the prior art.
Figure 8:
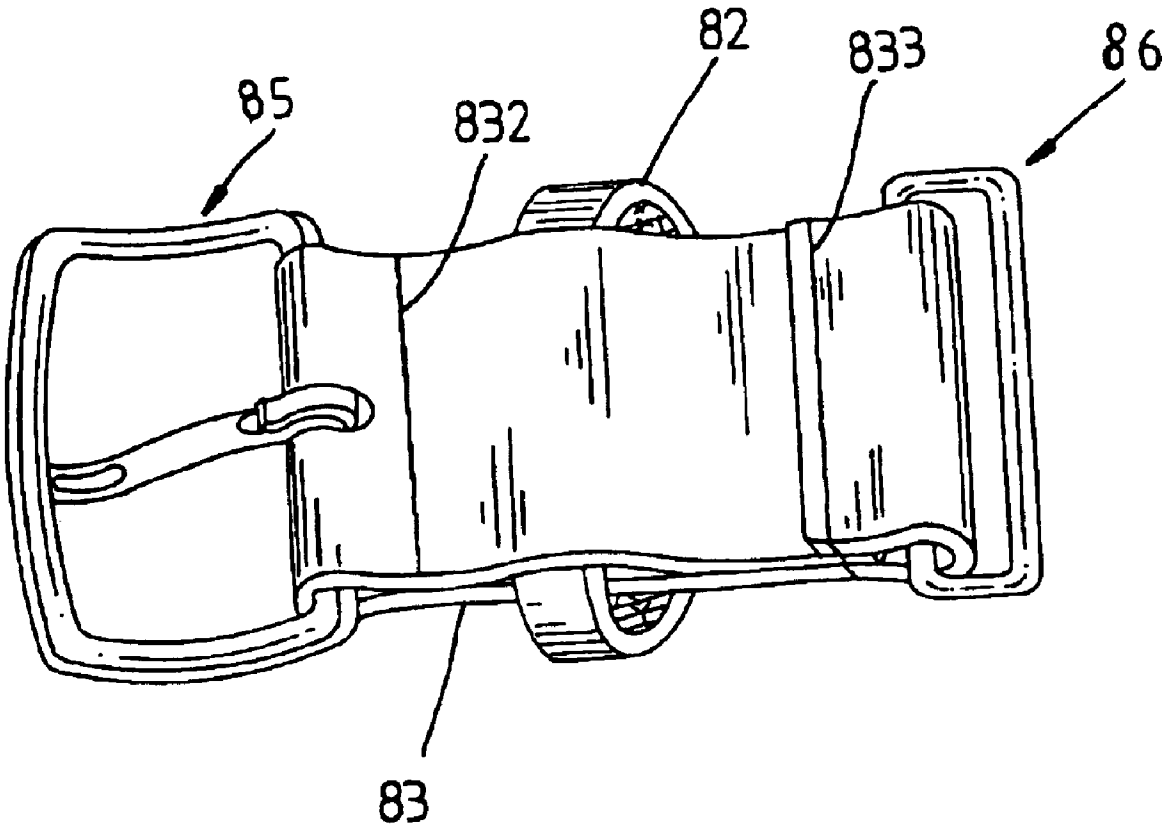
Fig. 8 PRIOR ART
FIG. 8 is an elevational view showing the headpiece fastened to the buckle, the keeper and the connecting ring according to the prior art.
Figure 9:
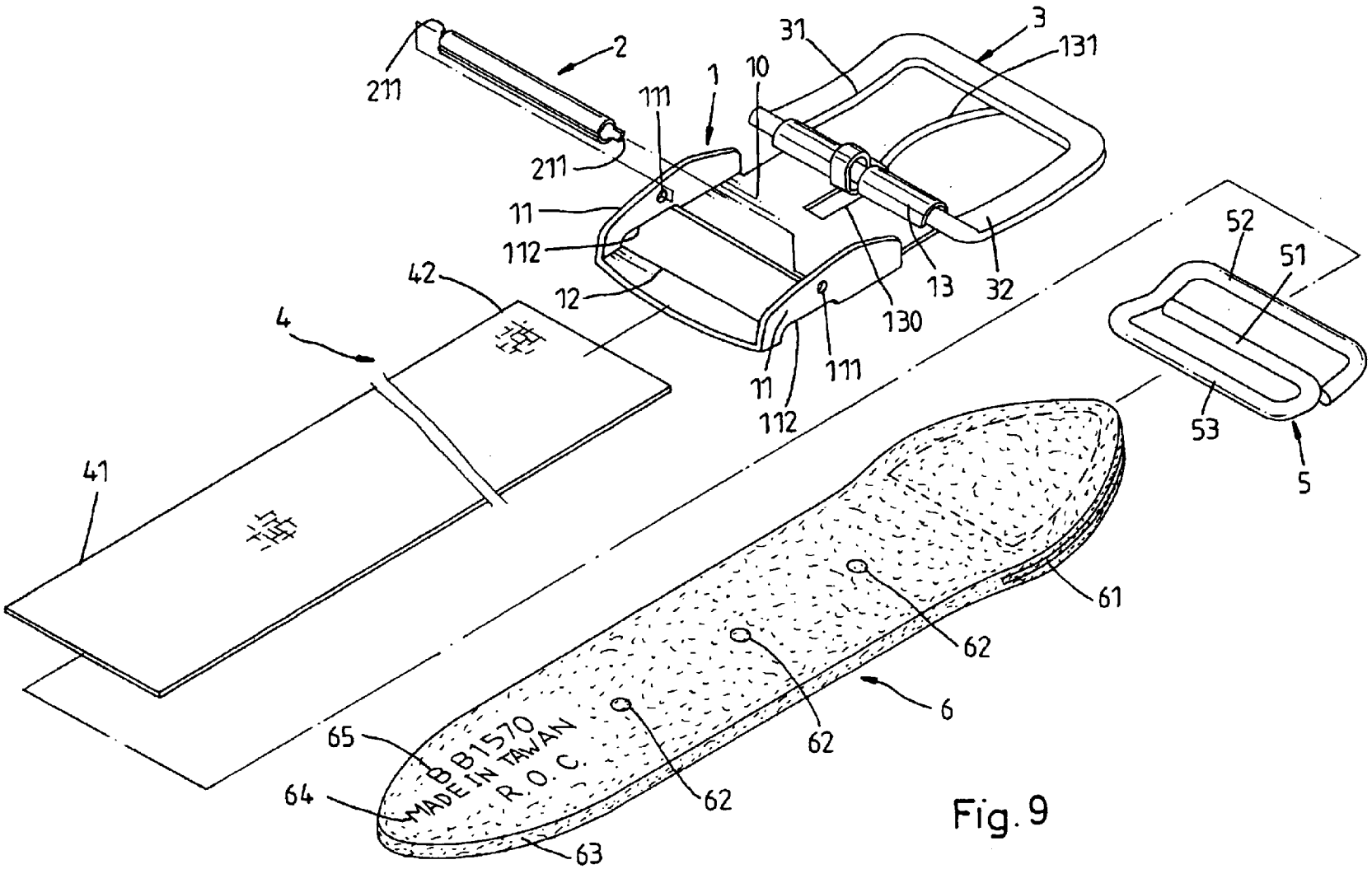
FIG. 9 is an exploded view of a belt for casual wear according to the present invention.
Figure 10:
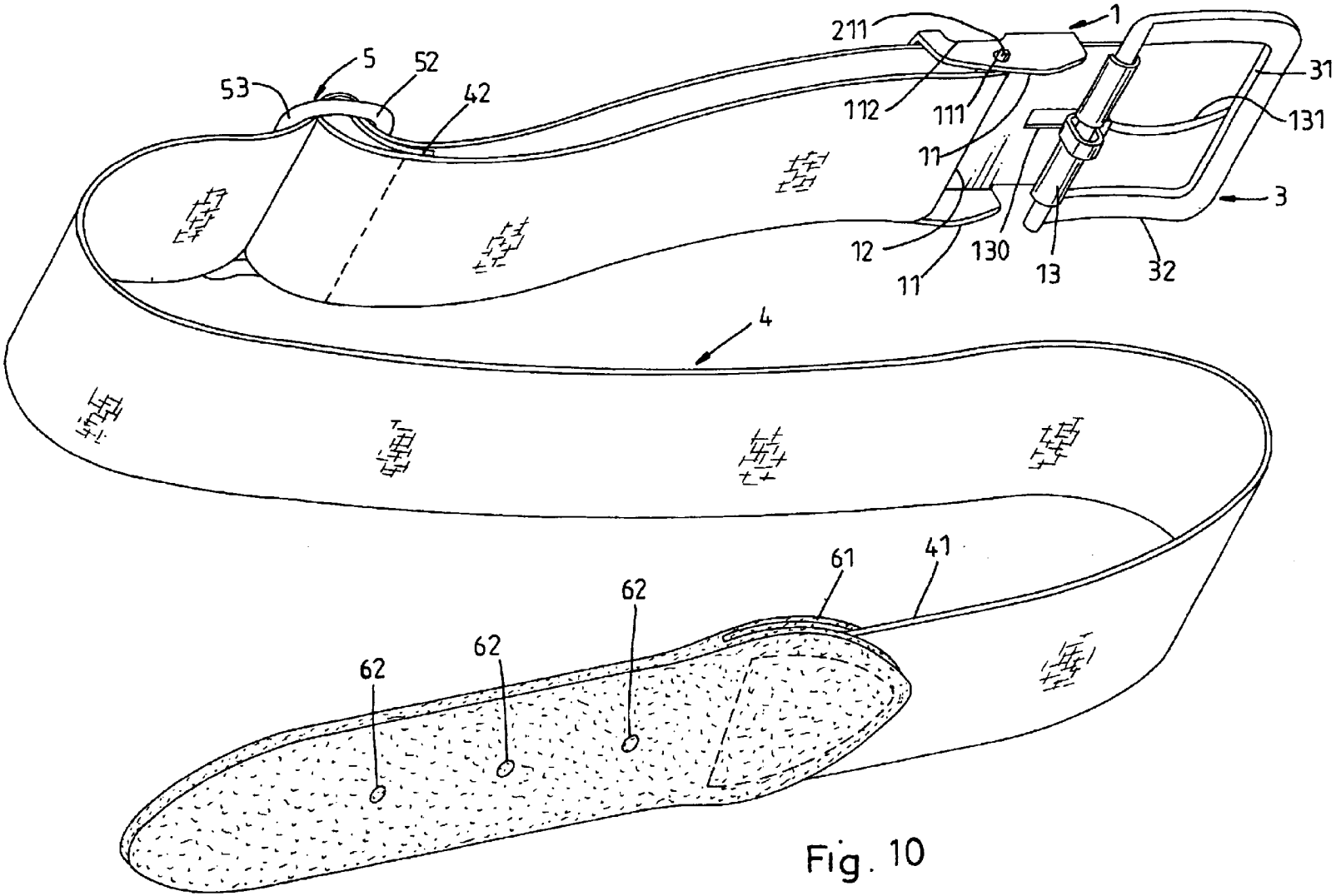
FIG. 10 is a perspective view of the belt for casual wear according to the present invention.
Figure 11:
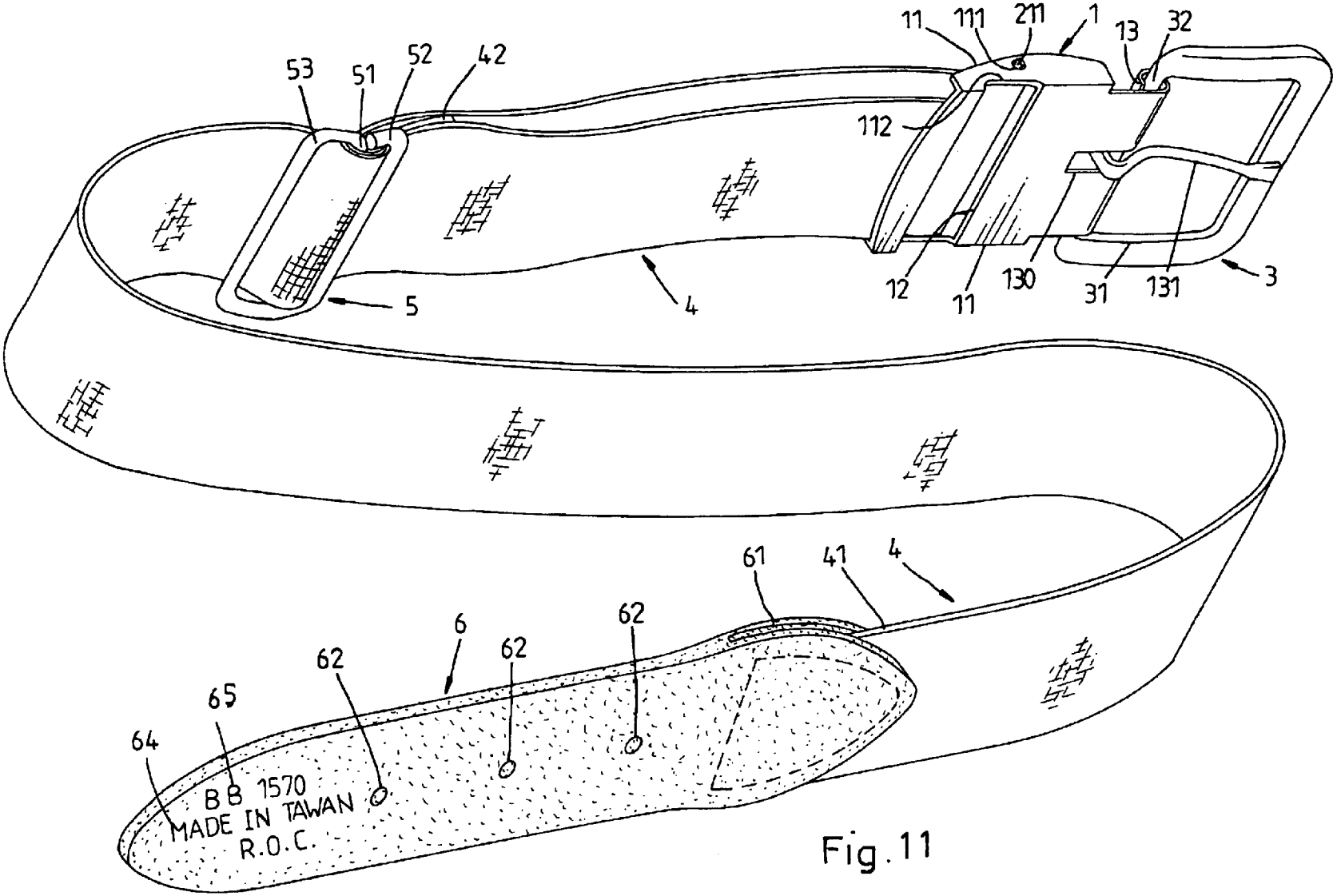
FIG. 11 is another perspective view of the belt for casual wear according to the present invention when viewed from another side.

Referring to FIGS. 9–12, a belt for casual wear in accordance with the present invention is shown comprised of a buckle base 1, a pivot 2, a buckle frame 3, a belt body 4, an adjustment frame 5, and a tailpiece 6.

The buckle base 1 is stamped from a metal plate, having two upright sidewalls 11, two pivot holes 111 respectively cut through the upright sidewalls 11, a transverse insertion slot 12 extended between the upright sidewalls 11, two side notches 112 respectively formed at the upright sidewalls 11 in communication with the ends of the transverse insertion slot 12, a front knuckle 13, a longitudinal slot 130 extended to the middle part of the front knuckle 13, and a prong pin 131 pivotally disposed at the middle of the front knuckle 13.

The pivot 2 has two end rods 211 respectively pivotally fastened to the pivot holes 111 at the upright sidewalls 11 of the buckle base 1.

The buckle frame 3 is a metal open frame having a substantially rectangular open body 31. The rear side 32 of the rectangular open body 31 is fastened pivotally with the front knuckle 13 and the prong pin 131.

The adjustment frame 5 is made by bending a metal rod into shape, having a transversely extended middle rod 51 and two insertion slots 52 and 53 separated by the transversely extended middle rod 51.

The tailpiece 6 is injection-molded from plastics, having an opening 61 at the front end, and a plurality of punch holes 62 longitudinally aligned in a line. Further, the inner side of the rear end 63 of the tailpiece 6 is marked with the marks of country of origin 64 and model number 65.

The belt body 4 is a strap of elastic fabric, having one end 41 inserted through the insertion slots 52 and 53 of the adjustment frame 5 and fastened to the transversely extended middle rod 51 with stitches, and the other end 42 inserted through the transverse insertion slot 12 over the pivot 2 and then inserted through the insertion slots 52 and 53 of the adjustment frame 5 and fastened to the opening 61 of the tailpiece 6 with stitches.

Figure 12:
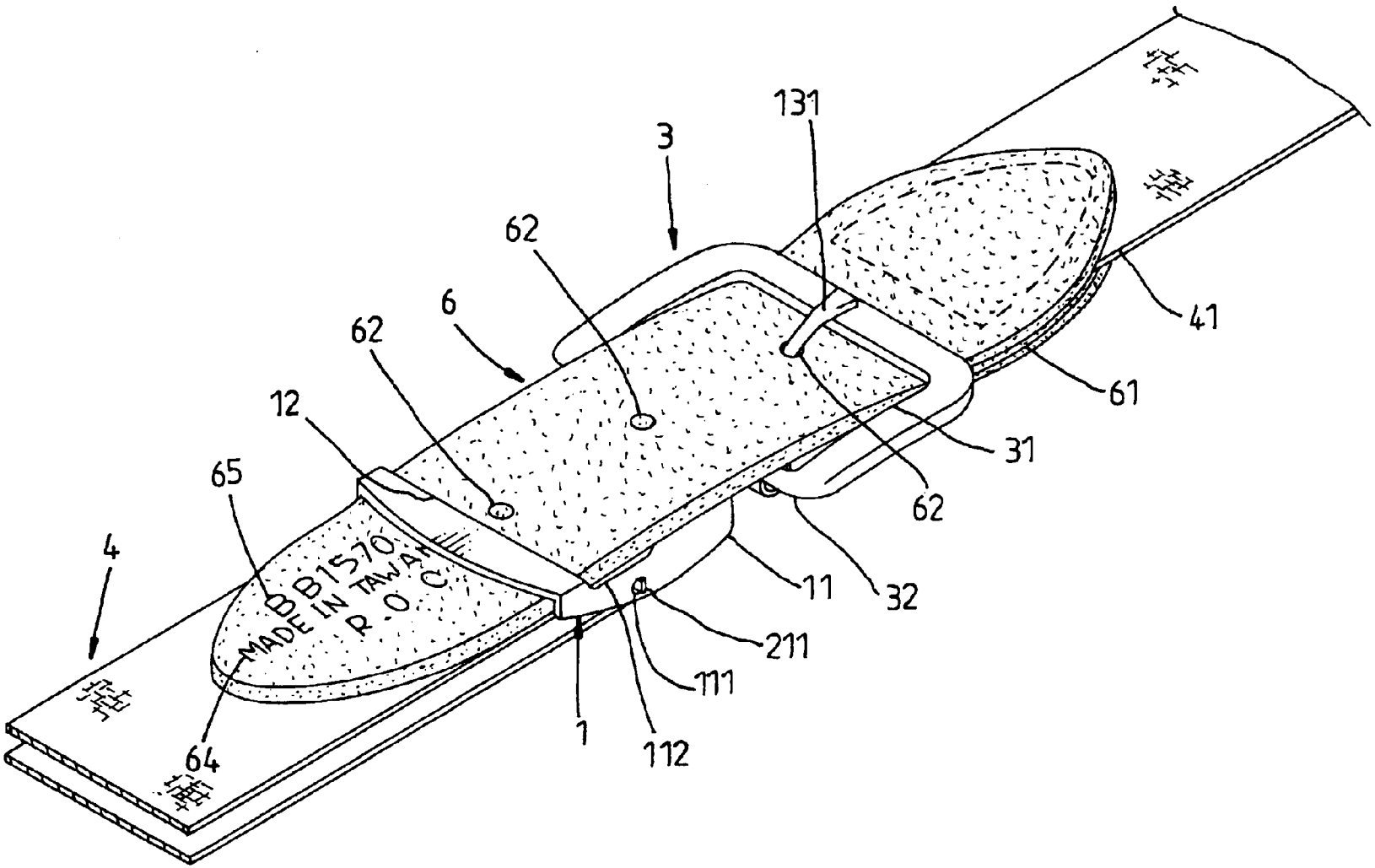
FIG. 12 is a perspective view of a part of the present invention, showing the rear end of the tailpiece secured in place between the belt body and the buckle base.

After insertion of the prong pin 131 into one punch hole 62, the rear end of the tailpiece 6 is inserted through the transverse insertion slot 12 and held down on the belt body 4 by the buckle base 1 (see FIG. 12). Because of the presence of the side notches 112 at the ends of the transverse insertion slot 12, the rear part of the tailpiece 6 can easily be inserted through the transverse insertion slot 12. Further, because the front knuckle 13 is an integrated part of the buckle base 1, the buckle frame 3 and the prong pin 131 can easily be fastened to the buckle base 1.

As indicated, the invention ahs the following advantages:

1. The formation of the transverse insertion slot 12 and the side notches 112 enables the rear end of the tailpiece 6 to be easily positioned after insertion of the prong pin 131 into one punch hole 62 at the tailpiece 6. Further, because the front knuckle 13 is an integrated part of the buckle base 1, the buckle frame 3 and the prong pin 131 can easily be fastened to the buckle base 1. This simple structural design diminishes material consumption and saves much labor, thereby reducing the manufacturing cost.
2. The tailpiece 6 can be made through a mass production process to lower the cost. Because the tailpiece 6 is made by injection molding, quality control is easy to achieve. Further, the buckle base 1 can also be made through a mass production process.
3. The marks of country of origin 64 and model number 65 are directly formed during injection molding of the tailpiece 6, saving much time and labor.
4. The tailpiece 6 and the buckle base 1 are durable in use, not easy to deform.
5. When adjusting the length during fabrication, directly adjust the relative position between the belt body 4 and the adjustment frame 5 without cutting the belt body 4.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A belt comprising:

a buckle base stamped from a metal plate, said buckle base having two upright sidewalls, two pivot holes respectively cut through said upright sidewalls, a transverse insertion slot extended between said upright sidewalls, two side notches respectively formed at said upright sidewalls in communication with two distal ends of said transverse insertion slot, a front knuckle, a longitudinal slot extended to a middle part of said front knuckle, and a prong pin pivotally disposed at a middle part of said front knuckle;

a pivot, said pivot has two end rods respectively pivotally fastened to the pivot holes at said upright sidewalls of said buckle base;

a metal buckle frame, said buckle frame having a substantially rectangular open body fastened pivotally with said front knuckle and said prong pin;

an adjustment frame, said adjustment frame having a transversely extended middle rod and two insertion slots separated by said transversely extended middle rod;

a tailpiece injection-molded from plastics, said tailpiece having an opening at a front end thereof, and a plurality of punch holes longitudinally aligned in a line, and a belt body made of elastic fabric, said belt body having a first end inserted through the insertion slots of said adjustment frame and fastened to the transversely extended middle rod of said adjustment frame with stitches, and a second end inserted through the transverse insertion slot of said buckle base over said pivot and then inserted through the insertion slots of said adjustment frame and fastened to the opening of said tailpiece with stitches.

* * * * *